US005509502A

United States Patent [19]

Beaulieu

[11] Patent Number: 5,509,502

[45] Date of Patent: Apr. 23, 1996

[54] CONSTRUCTION ELEVATOR

[75] Inventor: Bryan J. Beaulieu, Burnsville, Minn.

[73] Assignee: Skyline Displays, Inc., Burnsville, Minn.

[21] Appl. No.: 237,859

[22] Filed: May 4, 1994

[51] Int. Cl.[6] ..... B66B 9/16

[52] U.S. Cl. ..... 187/242; 52/123.1

[58] Field of Search ..... 187/242, 414, 187/239, 267, 268, 900; 182/63, 141; 52/123.1, 127.1, 127.2, 111, 121, 122.1, 745.17

[56] References Cited

U.S. PATENT DOCUMENTS

| | | | |
|---|---|---|---|
| 2,576,389 | 11/1951 | Craighead et al. | 182/63 |
| 3,185,265 | 5/1965 | White | 52/123.1 |
| 3,266,211 | 8/1966 | Hughes | 52/123.1 |
| 3,751,863 | 8/1973 | Lyons | 52/111 |
| 3,828,513 | 8/1974 | Vanderklaauw | 52/123.1 |
| 4,298,128 | 11/1981 | Gattu | 212/267 |
| 4,337,868 | 7/1982 | Gattu | 212/267 |
| 4,358,915 | 11/1982 | Pantalone | 52/115 |
| 4,783,934 | 11/1988 | Langhart et al. | 52/64 |

*Primary Examiner*—Kenneth Noland
*Attorney, Agent, or Firm*—Palmatier, Sjoquist & Helget

[57] ABSTRACT

An elevator apparatus for providing an elevated support structure. The apparatus is comprised of a base unit, a plurality of tower sections, and an elevating device. The tower sections may be individually inserted into the base unit where the elevating device operates to raise the base unit whereby an additional tower section may be inserted and connected to the previous tower section. The elevating device is then lowered to the just inserted tower section and repetition of the sequence affects an erection of the tower. Outrigger legs with pads extend from the base unit to provide vertical stability. Guy lines extend from the tower to the ends of the outrigger legs to a winch arrangement within the base unit permitting guy lines to remain taught during the raising or lowering of the tower. Further, ballast containers are provided at the base unit intermediate adjacent outrigger legs for providing additional stability against tip-over.

12 Claims, 6 Drawing Sheets

CONSTRUCTION ELEVATOR

BACKGROUND OF THE INVENTION

This invention relates to an elevator apparatus for elevating and supporting equipment, displays, personnel and the like. More particularly, the invention relates to an erectable tower structure.

Such structures may be utilized in outdoor locations where they are subjected to wind, requiring structural integrity and supplemental stability means.

Tower structures which may be raised and lowered relatively easily and conveniently transported from location to location are useful in a variety of applications. Such structures may be used for providing elevated support of lighting equipment, sound equipment, electrical equipment, and communications equipment. Additionally, portable tower structures may also be used for providing the support for platforms, exhibits, displays, and statues. In the construction industry such tower structures have applications such as the vertical support for cranes and the structure for cabled elevator cars.

In many applications equipment such as cranes for assembling or erecting tower structures are not available or are not practical. For safety reasons it is advantageous for assembly personnel to be able to stay at the ground or floor level if possible for the assembly and disassembly of tower structures.

SUMMARY OF THE INVENTION

An elevator apparatus for providing an elevated support structure. The apparatus is principally comprised of a base unit, a tower comprised of a plurality of tower sections, and an elevating means. The tower sections are vertically connectable to each other and are individually insertable into the base unit where the elevating means operates to raise the section allowing an additional tower section to be inserted underneath the section and connected to the previously inserted tower section. The elevating means is then lowered to the just inserted tower section and repetition of the sequence affects an erection of the tower. Stability is provided by outrigger legs with pads extending from the base unit along with guy lines extending from the tower to the ends of the outrigger legs. A winch arrangement within the base unit permits the guy lines to remain taught during the raising or lowering of the tower. Ballast containers are provided at the base unit intermediate adjacent outrigger legs for providing additional stability.

An advantage of the present invention is that personnel involved in the assembly and disassembly may remain substantially at the level of the base unit during the entire assembly or disassembly process. This provides significant safety advantages over structures which require assemblers to climb or work at elevated levels.

Another safety advantage is that as the tower is erected the tower sections are never freely suspended above ground, that is, the tower sections need not be elevated except when they are part of and attached to the tower.

Another advantage of the invention is that during the raising or lowering of the tower, the tower may be continually supported by the guy lines extending to the ends of the outrigger legs providing stability.

An additional advantage of the invention is that with sufficient gear reduction within the elevating means and the winching means no power equipment is needed for assembly or disassembly of the apparatus.

An additional advantage of the invention is that when disassembled the apparatus may be easily transported or stored due to the sectional nature of its individual components.

An additional advantage of the invention is that great flexibility is provided in the height to which the tower may be erected.

DETAILED DESCRIPTION OF THE PREFERRED EMBODIMENTS

Figure 1:
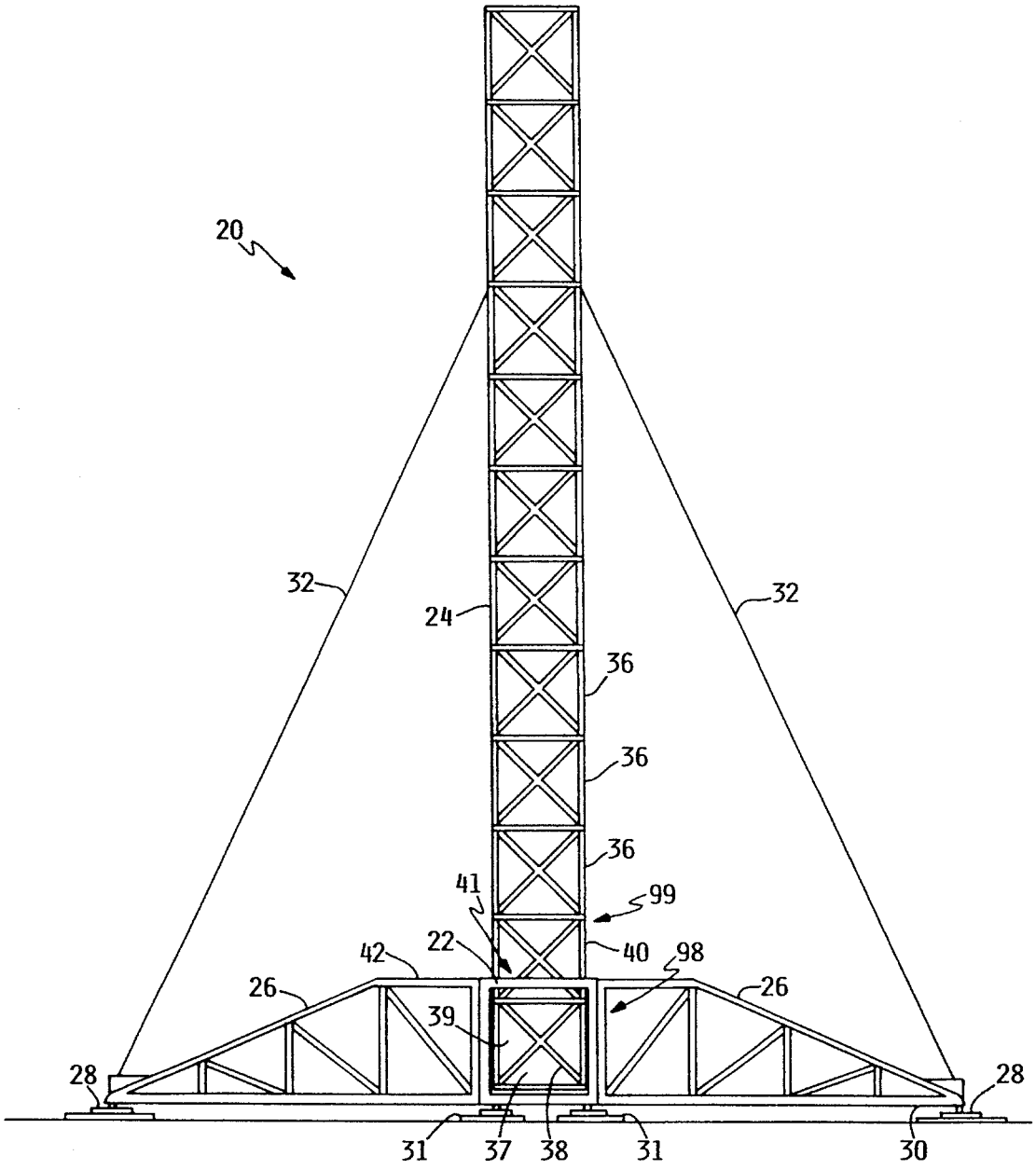
FIG. 1 shows an elevation of the elevator apparatus with the tower in a raised position.

Referring to FIG. 1, an elevator apparatus is shown in elevation and is generally identified by reference number 20. The apparatus is principally comprised of a base unit 22 from which extends a tower 24 and outrigger legs 26 with adjustable leveling pads 28 located at ends 30 of the outrigger legs 26. Adjustable pads 31 extend downwardly from the base unit 22. Guy lines 32 extend from the ends 30 of the outrigger legs 26 and attach to the tower 24. The tower 24 is comprised of a plurality of uniform tower sections 36.

The base unit 22 has an open front 37 and an interior 39. The lowest section of the tower 24 is visible through the open front 37 in the interior 39 of the base unit 22 and is designated as a first tower section 38. Immediately above the first tower section 38 and extending through the open top 41 is a second tower section 40.

Figure 2:
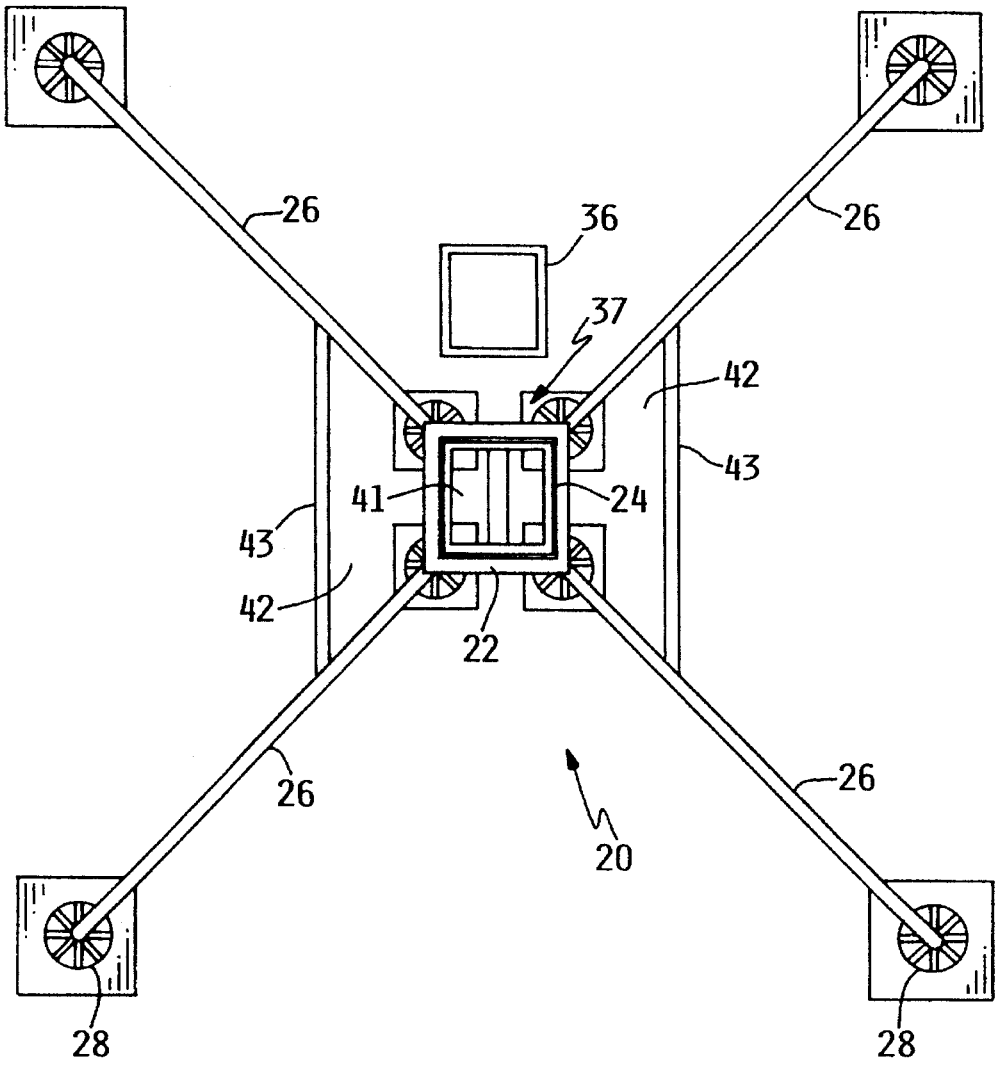
FIG. 2 shows a plan view of the elevator apparatus.

Referring to FIG. 2, a plan view of the elevator apparatus 20 is shown. This view best shows the placement of the four outrigger legs 26 with pads 28. Two ballast containers 42 are located on opposite sides of the base unit 22. Walls 43 connecting the adjacent outrigger legs 26 define the ballast containers. FIG. 2 also shows a tower section 36 in position for insertion into the base unit 22.

Figure 3:
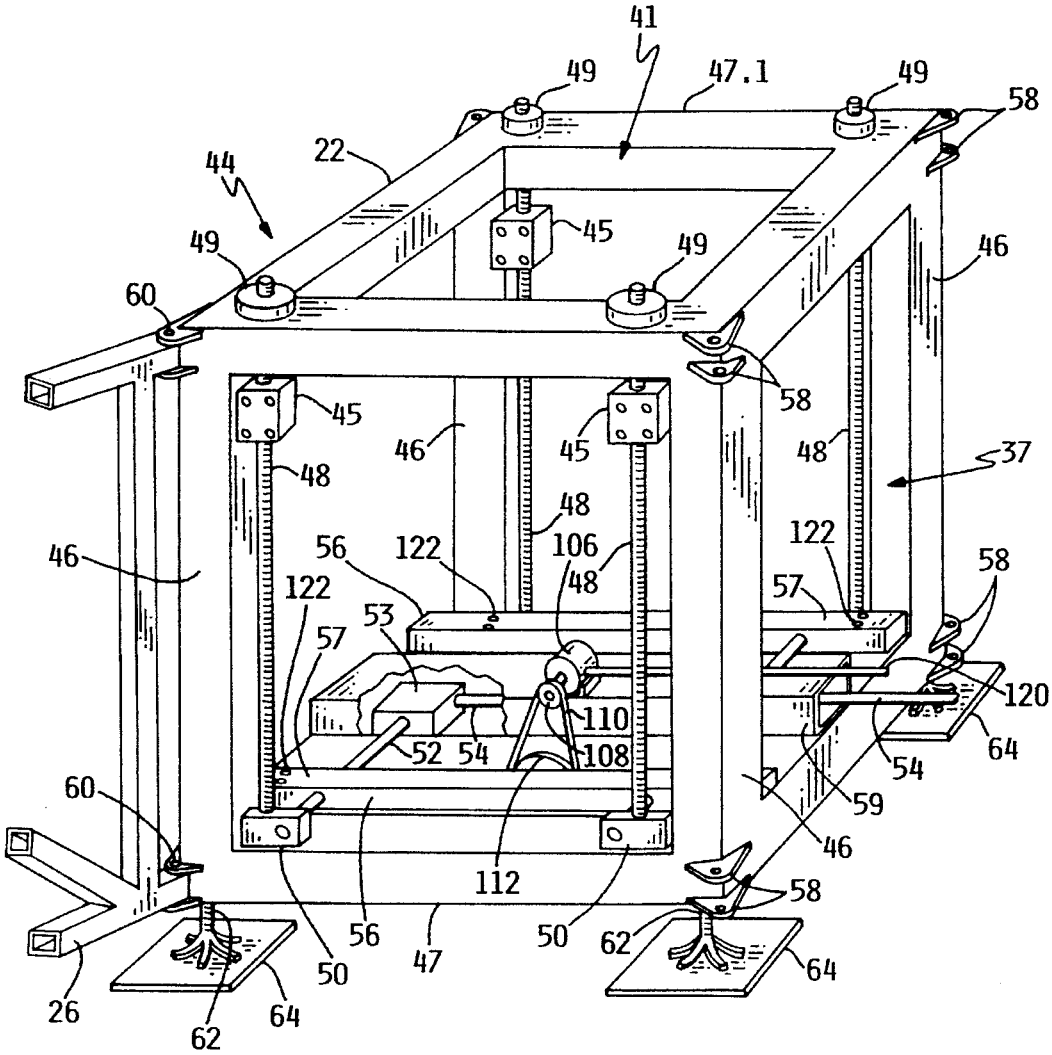
FIG. 3 shows a perspective view of the base unit of the elevator apparatus with the elevator means and winching means.

Referring to FIG. 3, the base unit 22 with elevator means 44 is shown in detail. The base unit is comprised of four upright structural members 46 connecting a square base bottom 47 and a square base top 48. In one preferred embodiment the height of the base unit may be approximately 68 inches with a depth and width of 58 inches. The base bottom 47, base top 47.1 and upright structural members 46 may be fabricated out of five inch square steel tubing with a 0.125 inch wall thickness and joined by welding. The outrigger legs in the preferred embodiment are appropriately 16 feet in length and may be fabricated out of 2×4 inch steel tubing with a wall thickness of 0.12 inches.

Figure 5:
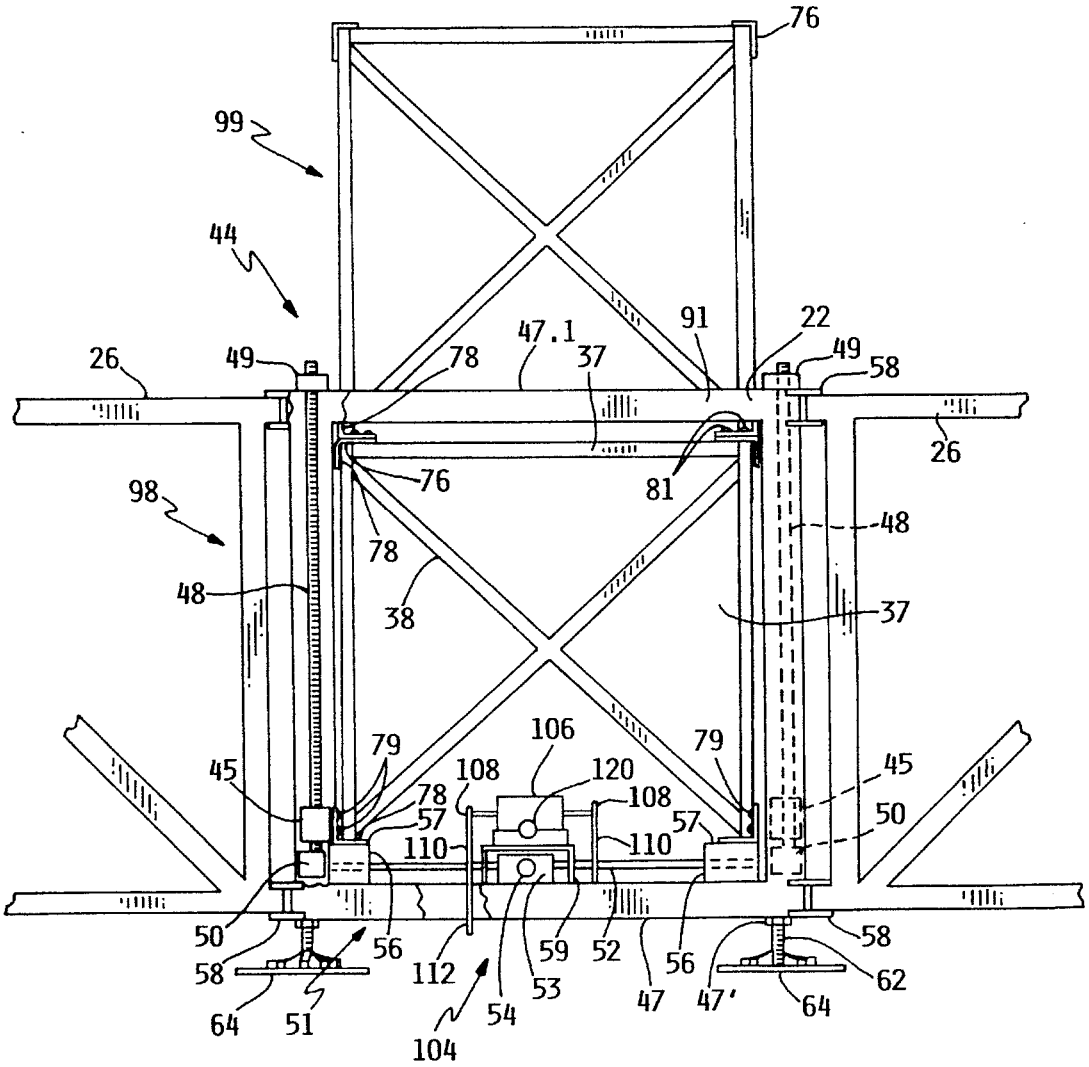
FIG. 5 shows an elevation from the front of the base unit with two tower sections and portions of two outrigger legs.
Figure 6:
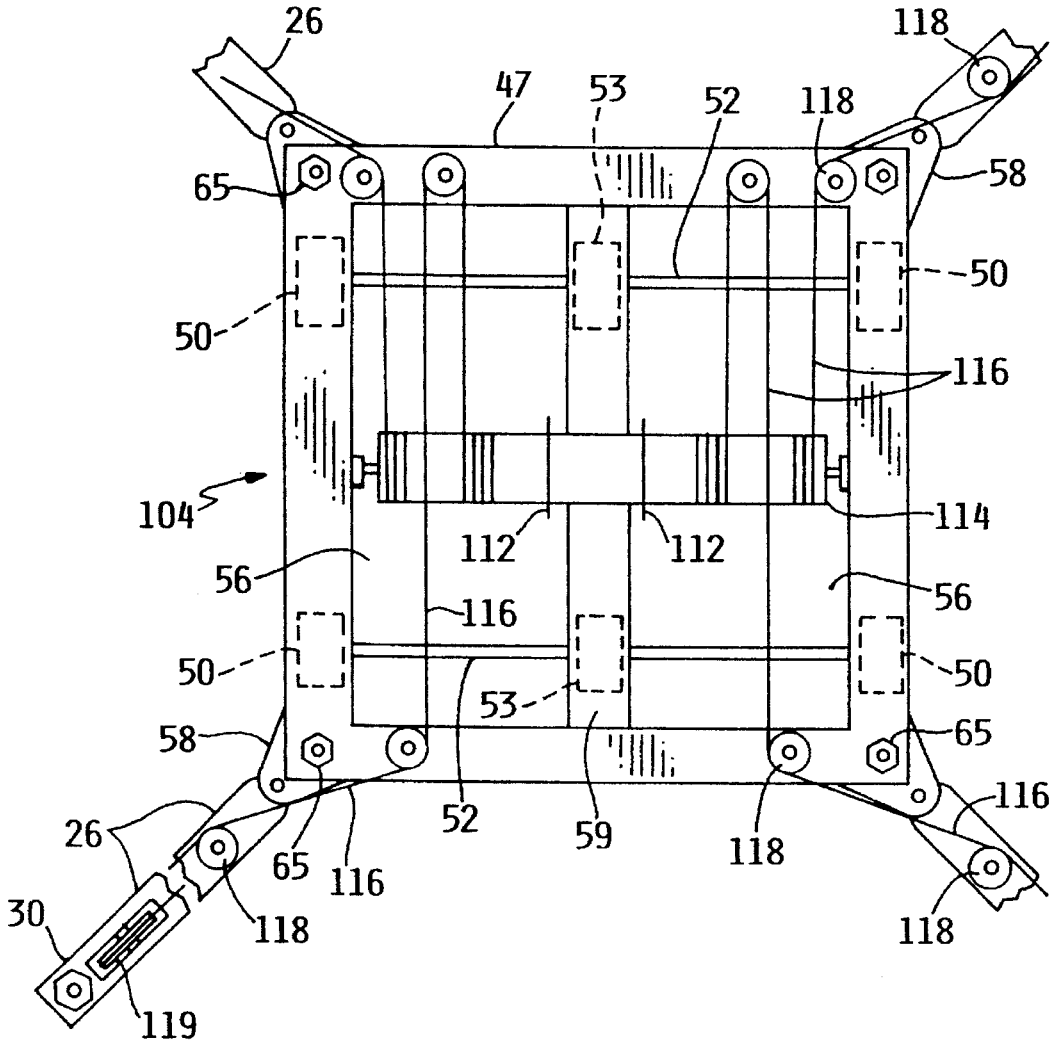
FIG. 6 shows a view of the bottom of the apparatus showing the winching means and guy lines.

Referring to FIGS. 3, 5, and 6, the elevator means 44 is comprised principally of four drive nuts 45, four threaded vertical shafts 48, four bearing blocks 49, and a rotation means 51 for the vertical shafts 48. The rotation means 51 for the vertical shafts comprises four gear reducers 50, four connecting shafts 52, two L-drives 53 and a drive shaft 54. The four threaded vertical shafts 48 are rotatably mounted in the base unit 22 by way of the bearing blocks 49 mounted to the square base top 47.1 and by the gear reducers 50 mounted to the base bottom 47. The drive nuts 45 are engaged with the vertical threaded shaft 48 whereby rotation of the threaded shafts 48 causes the drive nuts 45 to move upwardly or downwardly depending on the thread orientation and the direction of rotation. The vertical threaded shafts 48 are rotated by the gear reducers 50 connected to the L-drives 53 by the connecting shafts 52. The L-drive 53 is driven by the drive shaft 54 which extends through the L-drives 53 out of the base unit 22. The drive shaft 54 may be rotated by suitable drive means (not shown) such as electric or internal combustion motors, or by a manual crank or pedal means if the gear reducers 50 have sufficient gear reduction. Other elevating means which would also be effective include hydraulic cylinders, a cable and drum mechanism, pneumatic cylinders, and jacking mechanisms.

Continuing to refer to FIGS. 3, 5 and 6, the base unit 22 has brackets 58 for mounting the four outrigger legs 26 by way of bolts 60, pins or other suitable connecting means. Extending downwardly from the base bottom 47 are four threaded leveling legs 62 with pads 64. The leveling legs 62 and pads 64 are conventionally mounted by such means as large diameter nuts 65 welded to the base bottom 47 as best shown in FIG. 6.

Two horizontal tower support members 56 and a middle support member 59 extend across the base bottom 47. The tower support members 56 may be fabricated out of four inch steel tubing with 0.188 inch wall thickness and the middle support member 59 may be fabricated from two 2×7 inch steel channel irons welded together to form a 4×7 inch rectangular tubing. The tower support members 56 have a tower support surface 57 on which the first tower section 38 sits.

Figure 4:
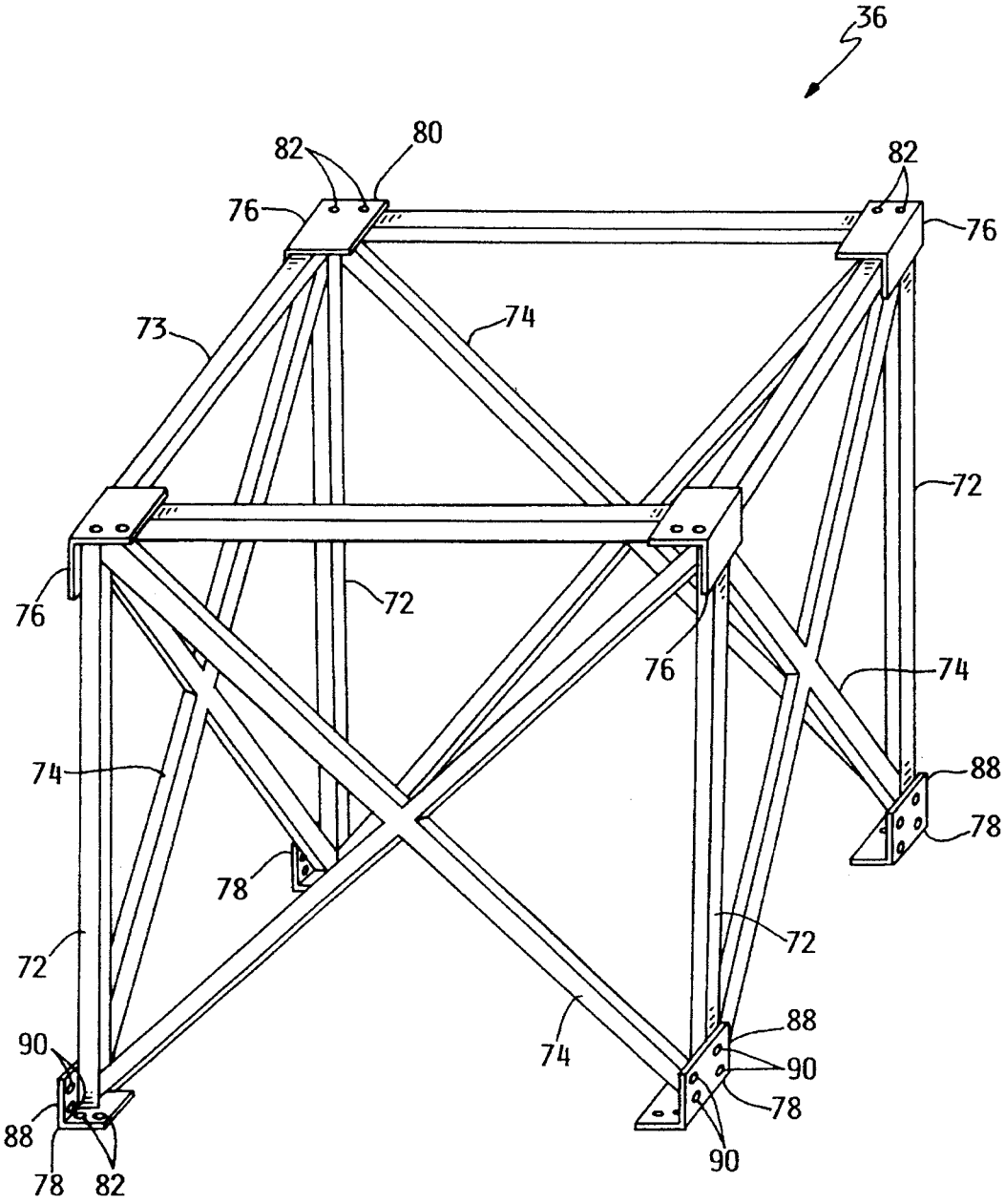
FIG. 4 shows a perspective view of an individual tower section.

Referring to FIG. 4, a detail drawing of a preferred embodiment of a tower section 36 is shown. The tower section 36 is generally cubical in outline with vertical support members 72, a square top portion 73, and cross-bracing 74. Four upper brackets 76 are shown mounted to the square top portion 74 by way of welding or other suitable means. Attached to the vertical support members 72 are lower lifting brackets 78. The upper brackets 76 and the lower lifting brackets 78 have horizontal plates 80 with holes 82. The horizontal plates 80 and holes 82 are aligned whereby stacked tower sections are connectable to each other by way of bolts 81 connecting the lower lifting brackets 78 of the upper section to the upper brackets 76 of the adjacent unit immediately below it as best shown in FIG. 5. The lower lifting brackets 78 also have a vertical plate 88 with holes 90 for connection to the drive nuts 45. The tower sections may be fabricated by conventional welding out of 2–3 inch square steel tubing with a height, depth and width of approximately 43 inches.

Referring to FIG. 5, the base unit 22 is shown with the open front 37 into which the tower sections may be inserted and removed. The base unit 22 is shown with two tower sections in place. The lower tower section within the base unit 22 is designated as in a first position 98 and the tower section immediately above the first portion is designated to be in a second position 99. Tower sections in the first position 98 rest on the tower support surface 57.

Referring to FIGS. 5 and 6, a winching means 104 for the guy lines is shown comprised of a gear reducer 106, small sprockets 108, chains 110, large sprockets 112, drum 114, mounting blocks, guy lines 116, pulleys 118, and a shaft 120. The gear reducer 106 in the preferred embodiment is a worm gear reducer which provides a self-locking feature to the winching means. The gear reducer 106 is connected to the small sprockets 108 which are connected by way of the chains 110 to the large sprockets 112 which are attached to the drum 114. The guy lines are anchored to and wound around the drum 114 and are directed out to the four outrigger legs 26 by way of the pulleys 118. At the ends 30 of the outrigger legs 26, best shown in FIGS. 1 and 6, the guy lines 116 are angled upwardly by pulleys 119 to the tower 24. Rotation of the shaft 120 thereby rotates the drum 114 to take in or let out the guy lines. A manual crank (not shown) or similar means may be used to rotate the shaft 120.

The elevator apparatus 20 operates as follows: Referring to FIGS. 2, 3 and 5, a tower section is inserted into the open front 37 of the base unit 22. The tower section 38 has its lower lifting brackets 78 resting on the tower support surface 57 as shown in FIG. 5. The drive nuts 45 are adjusted vertically for alignment with the lower lifting brackets 78 by rotation of the drive shaft 54 which rotates vertical shafts 48. When in an appropriate position the drive nuts 45 are engaged with the tower section by bolts 79 inserted through the lifting brackets 78 and into or through the drive nuts 45. The drive shaft 54 is rotated to cause upwardly movement of the four drive nuts 45 and the attached tower section 34. The tower section is raised to the second position 99 at which point an additional tower section is inserted into the base unit 22 through the open front 37. The tower section in the second position 99 is then adjusted where its tower lifting brackets 78 are aligned to the upper brackets 76 of the just inserted tower section in the first position 98. Bolts 81 or other suitable fastening means connect the brackets and thus the adjacent tower sections. The bolts 79 attaching the lower lifting bracket 78 of the tower section in second position 99 to the drive nuts 45 are then removed, the drive shaft 54 is rotated to lower the drive nuts 45 to the lifting brackets on the just inserted tower section located in the first position 98. The drive nuts 45 are then attached to the lower lifting brackets 78 of said tower section and the sequence is repeated effecting an assembly and raising of the tower 24. The tower 24, as depicted in FIG. 1, with twelve tower sections has a height of approximately 48 feet.

At an appropriate tower section during raising of the tower, which in FIG. 1 is depicted as being three tower sections down, the guy lines 116 extending from the four outrigger legs 26 may be attached to the tower 24 by any suitable means. This may be best accomplished when the appropriate tower section is in the second position 99. Referring to FIG. 6, when the guy lines 116 are attached, the shaft 120 is rotated to drive gear reducer 106, which turns sprockets 108, chains 110 and large diameter sprockets 112 rotating the drum 114 whereby the guy line may be let out but still kept taught as the tower 24 is raised.

When the tower has been raised to the desired elevation, the lower lifting brackets 78 may be attached to the horizontal tower support members 45 by way of the holes 122 as shown in FIG. 3. The drive nuts 45 may remain connected to the lower lifting brackets 78 of the tower section in the second position 99 providing additional stability to the raised elevator apparatus.

The lowering and disassembly of the tower 24 is accomplished in a reverse manner. With the drive nuts 45 attached to the lower lifting brackets 78 of the tower section in the second position 99, the drive nuts 45 may be slightly elevated to unweight the tower 24 from the tower support surface 57. The connection between the bolts 81 on the brackets 76, 78 connecting the two tower sections in the first and second positions 98, 99 are removed and the tower section in the first position 98 is removed from the base unit 22. The drive nuts 45 attached to the tower section in the second position are then lowered to where said tower section comes to rest upon the tower support surface 57. The drive nuts 45 are disconnected from the lowered tower section and are raised to connect to the lower lifting brackets 78 of the tower section in the second position. The sequence is thus repeated until the tower has been lowered to the desired height or disassembled. Similar to the raising operation, the guy lines 32 may be taken up on the drum 114 as the tower 24 is lowered to maintain stability.

Depending on the application and the height of the tower, it may be desirable to put ballast in the form of sand, water, or other materials in the ballast containers 42 for additional stability.

The present invention may be embodied in other specific forms without departing from the spirit or essential attributes thereof, for example, the base 22 and tower sections 36 may be of other polygonal shapes than the square or rectangular shapes shown. It is therefore desired that the present embodiment be considered in all respects as illustrative and not restrictive, reference being made to the appended claims rather than to the foregoing description to indicate the scope of the invention.

What is claimed is:

1. An elevator apparatus comprising:

a) a base unit having an open interior, an open front, an open top and a tower support surface;

b) a vertical tower extending upwardly through the open top of the base unit, the tower comprised of a plurality of vertically stacked tower sections of a uniform height, the tower sections connectable and disconnectable to each other, each section sized to pass through the open front of the base unit; and c) an elevating means attached to the base unit for raising and lowering the vertical tower, comprising a threaded vertical shaft rotatably mounted in the base unit, a drive nut engaged on the vertical shaft, and a rotation means for rotating the vertical shaft, the elevating means removably engageable with the vertical tower by way of engagement with individual tower sections and movable a vertical distance at least the height of a tower section, whereby the tower may be raised for insertion and connection of additional tower sections through the open front effecting raising of the tower; and d) a releasable attachment means for securing the vertical tower in the raised position to the base unit.

2. The apparatus of claim 1, wherein the rotation means comprises reduction gearing and a drive means.

3. The apparatus of claim 2, further comprising at least three outrigger legs, each connected to the base unit and extending substantially horizontally from the base unit, each outrigger leg having a pad.

4. The apparatus of claim 3, further comprising a ballast container attached to the base unit.

5. The apparatus of claim 4, further comprising a guy line for each outrigger leg, and a winching means attached to the base unit, each guy line connected to the vertical tower and extending to the end of the horizontal support and to the winching means, whereby the guy lines may be extended as the tower is elevated and retracted as the tower is lowered.

6. The apparatus of claim 5, wherein the winch means is comprised of a drum rotatably mounted to the base unit, a worm gear reducer connected to the drum, a rotatable shaft connected to the worm gear reducer and a drive means for rotating said shaft.

7. An elevator apparatus comprising:

a) a base unit having an open interior, an open end, an open top and a tower support surface;

b) a vertical tower extending upwardly through the open top of the base unit, the tower comprised of a plurality of vertically stacked tower sections, the tower sections connectable and disconnectable to each other, each section with uniform heights and sized to be insertable and removable through the open front of the base unit into the open interior, the vertical tower including a first tower section in a first position on the tower support surface and a second tower section in a second position immediately above the first tower section; and c) an elevating means attached to the base unit for raising and lowering the vertical tower, comprising a threaded vertical shaft rotatably mounted in the base unit, a drive nut engaged with the vertical shaft, and a rotation means for rotating the vertical shaft, the elevating means removably engageable with the vertical tower and movable a vertical distance at least the height of a tower section, whereby the tower section in the first position may be engaged and raised into the second position for insertion and connection of an additional tower section into the first position effecting a raising of the tower and whereby the tower section in the second position maybe engaged, and disconnected from the tower section in the first position, permitting the removal of the tower section in the first position and the lowering of the tower section in the second position to the first position effecting a lowering of the tower; and d) a releasable attachment means for securing the tower section in the raised position to the base unit.

8. The apparatus of claim 7, wherein the rotation means comprises reduction gearing and a drive means.

9. The apparatus of claim 8, further comprising at least three outrigger legs extending substantially horizontally from the base unit, each outrigger leg having a pad.

10. The apparatus of claim 9, further comprising a ballast container attached to the base unit.

11. The apparatus of claim 10, in which each horizontal support further comprises a guy line for each horizontal support, each guy line connected to the vertical tower and extending to the end of the horizontal support and to a winching means, whereby the guy lines are extended as the tower is elevated and retracted as the tower is lowered.

12. The apparatus of claim 11, wherein the winch means is comprised of a rotatable shaft mounted to the base unit and a drive means for rotating said shaft.

* * * * *